US009557064B2

(12) United States Patent
Christiansen et al.

(10) Patent No.: US 9,557,064 B2
(45) Date of Patent: Jan. 31, 2017

(54) COOKING HOB INCLUDING A USER INTERFACE

(71) Applicant: Electrolux Home Products Corporation N. V., Brussels (BE)

(72) Inventors: Svend Erik Christiansen, Forli (IT); Laurent Jeanneteau, Forli (IT); Martin Kessler, Rothenburg ob der Tauber (DE); Alex Viroli, Forli (IT); Thibaut Rigolle, Forli (IT); Bryan Thomas Phillips, Springfield, TN (US)

(73) Assignee: ELECTROLUX HOME PRODUCTS CORPORATION N.V., Brussels (BE)

( * ) Notice: Subject to any disclaimer, the term of this patent is extended or adjusted under 35 U.S.C. 154(b) by 0 days.

(21) Appl. No.: 14/648,100

(22) PCT Filed: Nov. 14, 2013

(86) PCT No.: PCT/EP2013/073825
§ 371 (c)(1),
(2) Date: May 28, 2015

(87) PCT Pub. No.: WO2014/086566
PCT Pub. Date: Jun. 12, 2014

(65) Prior Publication Data

US 2015/0308694 A1 Oct. 29, 2015

(30) Foreign Application Priority Data

Dec. 5, 2012 (EP) ..... 12195590

(51) Int. Cl.
*H05B 6/06* (2006.01)
*H05B 6/12* (2006.01)
*F24C 7/08* (2006.01)

(52) U.S. Cl.
CPC ..... *F24C 7/086* (2013.01); *F24C 7/083* (2013.01); *H05B 6/12* (2013.01); *H05B 6/1218* (2013.01)

(58) Field of Classification Search
CPC ... H05B 6/062; H05B 6/1209; H05B 2213/05; H05B 2213/03
(Continued)

(56) References Cited

U.S. PATENT DOCUMENTS 4,149,217 A * 4/1979 Tucker ..... H05B 6/062 219/492
4,511,781 A * 4/1985 Tucker ..... H05B 6/062 219/506
(Continued)

FOREIGN PATENT DOCUMENTS

DE 102005018298 A1 10/2006
DE 202006019447 U1 * 3/2007 ..... H03K 17/96
(Continued)

OTHER PUBLICATIONS

International Search Report for PCT/EP2013/073825, dated Mar. 25, 2014, 3 pages.

*Primary Examiner* — Quang Van
(74) *Attorney, Agent, or Firm* — Pearne & Gordon LLP

(57) ABSTRACT

A cooking hob includes a transparent or semi-transparent top panel and a cooking zone with a pot detector. A user interface is below the top panel and includes touch switches and a touch slide. A light source corresponds with the touch switch and the cooking zone. The light source indicates detection of a pot on the cooking zone by a first light signal during a predetermined time interval and indicates an activated state of the cooking zone by a second light signal and indicates the selected cooking zone and the activated state of the touch slide element by the first light signal. The touch slide is for adjusting the power and/or temperature of the
(Continued)

Figure 1:
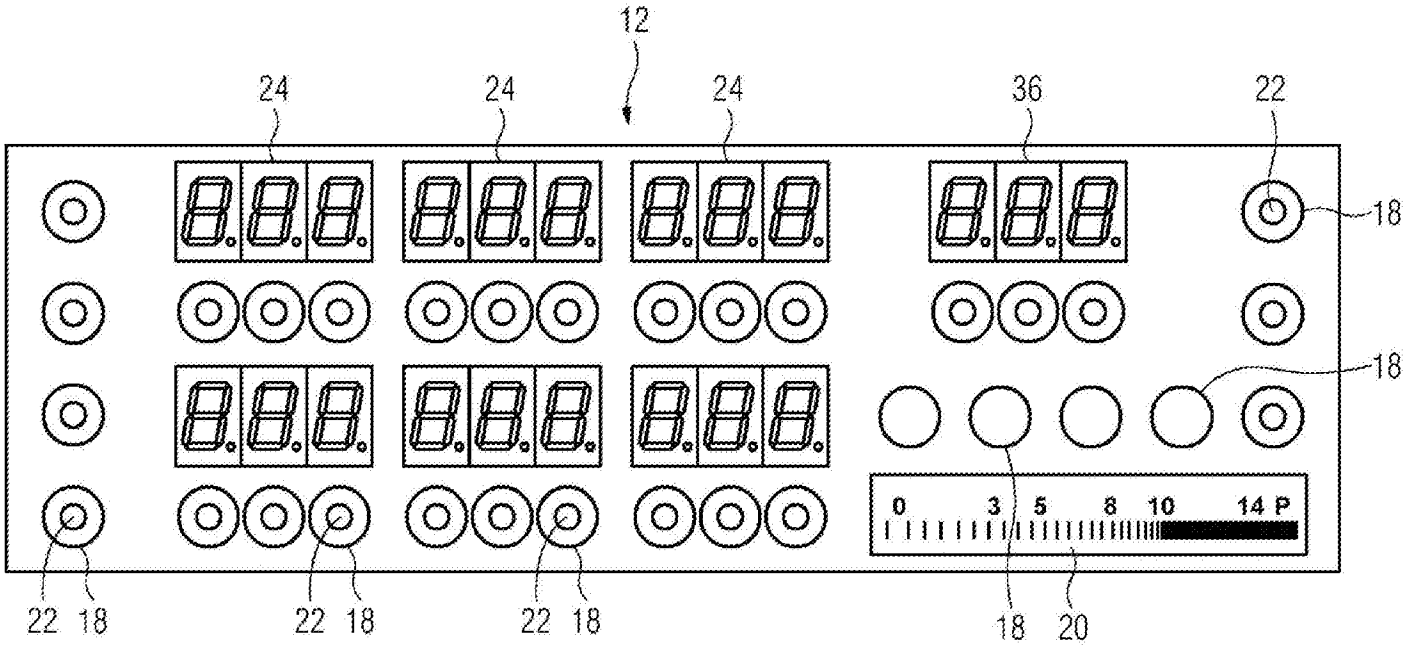

indicated cooking zone within the time interval. The touch switch is for selecting the cooking zone and activating the touch slide. The touch slide is for adjusting the power and/or temperature of the selected cooking zone.

15 Claims, 3 Drawing Sheets

(58) Field of Classification Search
USPC ..... 219/620, 621, 622, 625, 626, 627, 506, 219/662, 665, 492; 99/330, 468, 476, 483, 99/516; 126/20, 369
See application file for complete search history.

(56) References Cited

U.S. PATENT DOCUMENTS

| | | | | | |
|---|---|---|---|---|---|
| 5,680,810 | A | * | 10/1997 | Sham | A47J 27/16 126/20 |
| 2011/0148773 | A1 | | 6/2011 | Rudolph | |

FOREIGN PATENT DOCUMENTS

| | | | | | |
|---|---|---|---|---|---|
| DE | 102009001934 | A1 | | 9/2010 | |
| DE | 102010062485 | B3 | | 4/2012 | |
| EP | 0967839 | A2 | | 12/1999 | |
| EP | 1272007 | A2 | | 1/2003 | |
| EP | 1344983 | A2 | | 9/2003 | |
| EP | 1876394 | A2 | | 1/2008 | |
| JP | 2009054521 | A | * | 3/2009 | H05B 6/12 |

* cited by examiner

COOKING HOB INCLUDING A USER INTERFACE

The present invention relates to a cooking hob including a user interface according to the preamble of claim 1. In particular, the cooking hob is an induction cooking hob. Further, the present invention relates to a user interface for a cooking hob.

Current cooking hobs often include a user interface with a display and touch screen. Such displays and touch screens base on LCD or TFT technology and allow a comfortable operation of the cooking hob. However, the LCD or TFT technology causes high costs.

DE 10 2009 001 934 A1 discloses a domestic appliance with at least one cooking hob. The cooking hob includes a number of cooking zones. Each cooking zone corresponds with a pot detection device and a display panel. After switching on the cooking hob, all display panels are activated. If a pot is detected on one of the cooking zones, then the power or temperature of said cooking zone may be controlled by a corresponding rotary knob or touch slide element.

EP 1 876 394 A2 discloses a touch slide element with a haptic structuring. Said structuring is obtained by a multiple printing. The haptic structuring allows an increased operator convenience and a more precise adjusting. For example, the touch slide element may be used on a cooking hob for controlling the power or temperature of a corresponding cooking zone.

DE 10 2005 018 298 A1 discloses a user interface with a touch slide element. The touch slide element provides two operation modes. In a first operation mode a static applying of a finger on the touch slide element is analysed as a punctual actuation. In a second operation mode a movement of the finger on the touch slide element is analysed as another signal, wherein said signal depends on the length of the movement of the finger on the touch slide element.

EP 0 967 839 A2 discloses a cooking hob including a user interface. The user interface is provided for adjusting the power of a cooking vessel arranged upon a heating element. The cooking vessel itself serves as user interface, wherein the position and/or the change of the position of the cooking vessel define the adjusted power.

DE 10 2010 062 485 B3 discloses a touch slide element with a plurality of operation areas. Each operation area includes a touch and/or proximity sensor. By touching or approximating the operation area by a finger a corresponding function is activated. If the finger is moved to another operation area, then another function corresponding with said other operation area is activated.

EP 1 344 983 A2 discloses a control panel of a cooking hob. A common switch is provided for controlling the power of the cooking zones, wherein the power of a selected cooking zone is controlled. The adjusted power is indicated by a display corresponding with the cooking zone. The activation and deactivation of each cooking zone is performed by a pot detection device. Instead of the pot detection device a selection switch for the cooking zones may be provided.

It is an object of the present invention to provide a cooking hob including a user interface, which overcomes the problem of high costs.

The object of the present invention is achieved by the cooking hob according to claim 1.

According to the present invention

- the user interface is arranged below the top panel, while touch sensitive areas are formed on the top side of said top panel and above said user interface,
- the first time interval is predetermined,
- the touch switch element is provided for selecting the corresponding cooking zone and activating the touch slide element during a second predetermined time interval,
- the light source element is provided for indicating the corresponding selected cooking zone and the activated state of the touch slide element by the first light signal,
- the touch slide element is provided for adjusting the power and/or temperature of the selected cooking zone within the second predetermined time interval, and
- the touch slide element is provided for activating the first light signal again, so that the power and/or temperature can be set for the last known selected zone, after the first light signal has been disappeared, if the touch slide element has not been operated by the user within the first predetermined time interval.

The core of the present invention is that the user interface of the cooking hob includes exclusively only low-cost components, wherein the most of said components have multiple functions. This is particularly possible by activating the touch slide element under certain conditions. If the pot is placed upon two or more cooking zones, then the light source elements of said cooking zones indicate the pot detection by the first light signal during the first predetermined time interval. In this case, the power and/or temperature of said cooking zones may be adjusted by operating the touch slide element within one step. Additionally, the detection of the pot on the cooking zone may be indicated by a sound signal.

In particular, the first light signal is a flashing light. Furthermore, the second light signal may be a continuous light. Alternatively or additionally, the first light signal and the second light signal may have different colours.

For example, the first predetermined time interval is between three and seven seconds, in particular five seconds.

In a similar way, the second predetermined time interval is between three and seven seconds, in particular five seconds.

Further, at least one cooking zone display element may correspond with one cooking zone. Preferably, the cooking zone display element includes one or more seven-segment displays.

Additionally, the user interface may comprise a timer with at least one timer display element. For example, the timer display element includes one or more seven-segment displays.

In particular, the timer is settable for a certain cooking zone, if said cooking zone is selected by touching the corresponding touch switch element and the first light signal is activated.

Moreover, the user interface may comprise a minute minder, wherein said minute minder is activatable and adjustable by corresponding touch switch elements.

Preferably, the minute minder has a priority for being shown by the timer display element before the duration of the selected cooking zone.

For example, the light source element includes at least one light emitting diode (LED).

In particular, the cooking hob is an induction cooking hob.

At last, the present invention relates to a user interface for a cooking hob mentioned above.

Novel and inventive features of the present invention are set forth in the appended claims.

Figure 2:
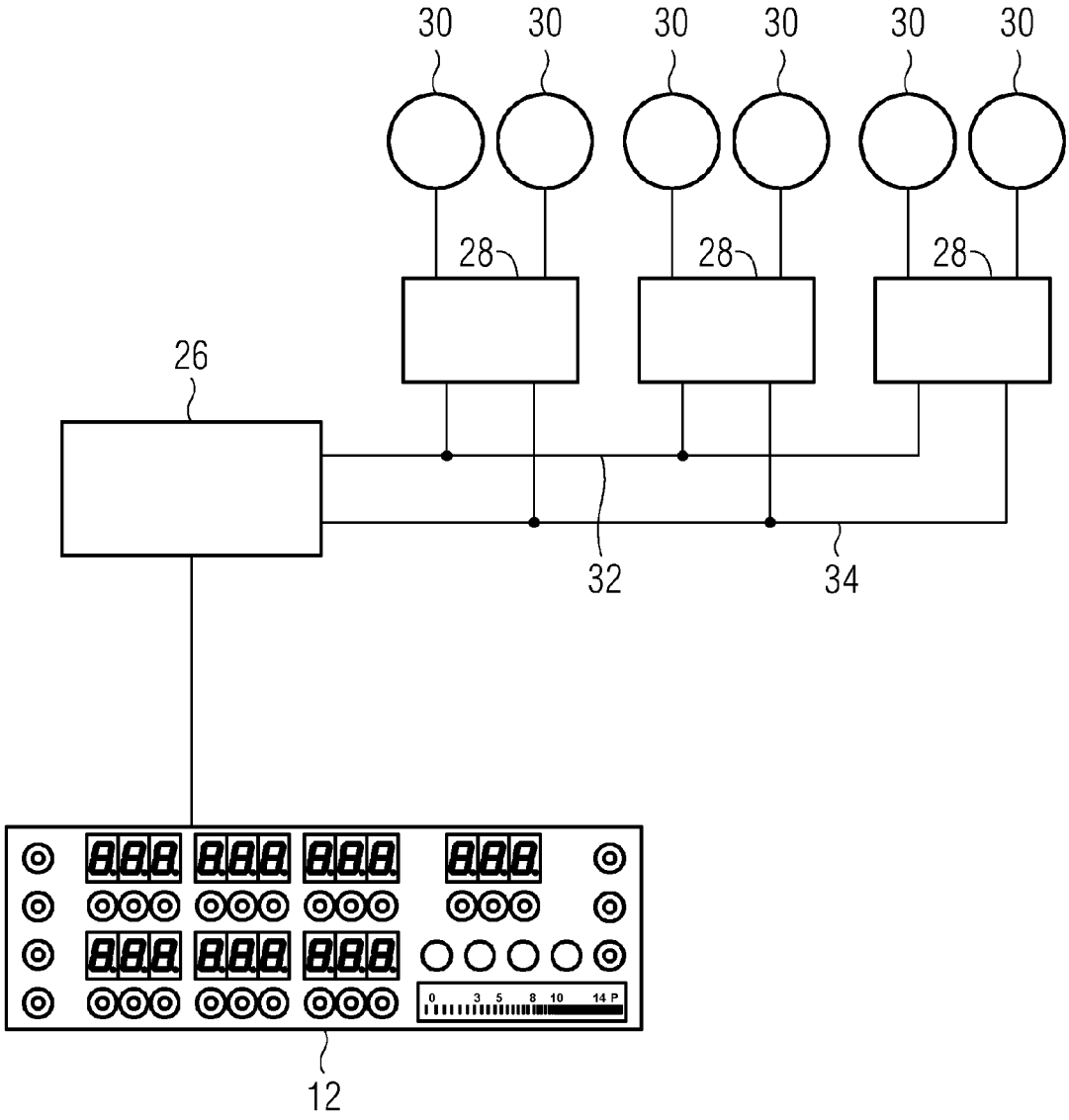
Figure 3:
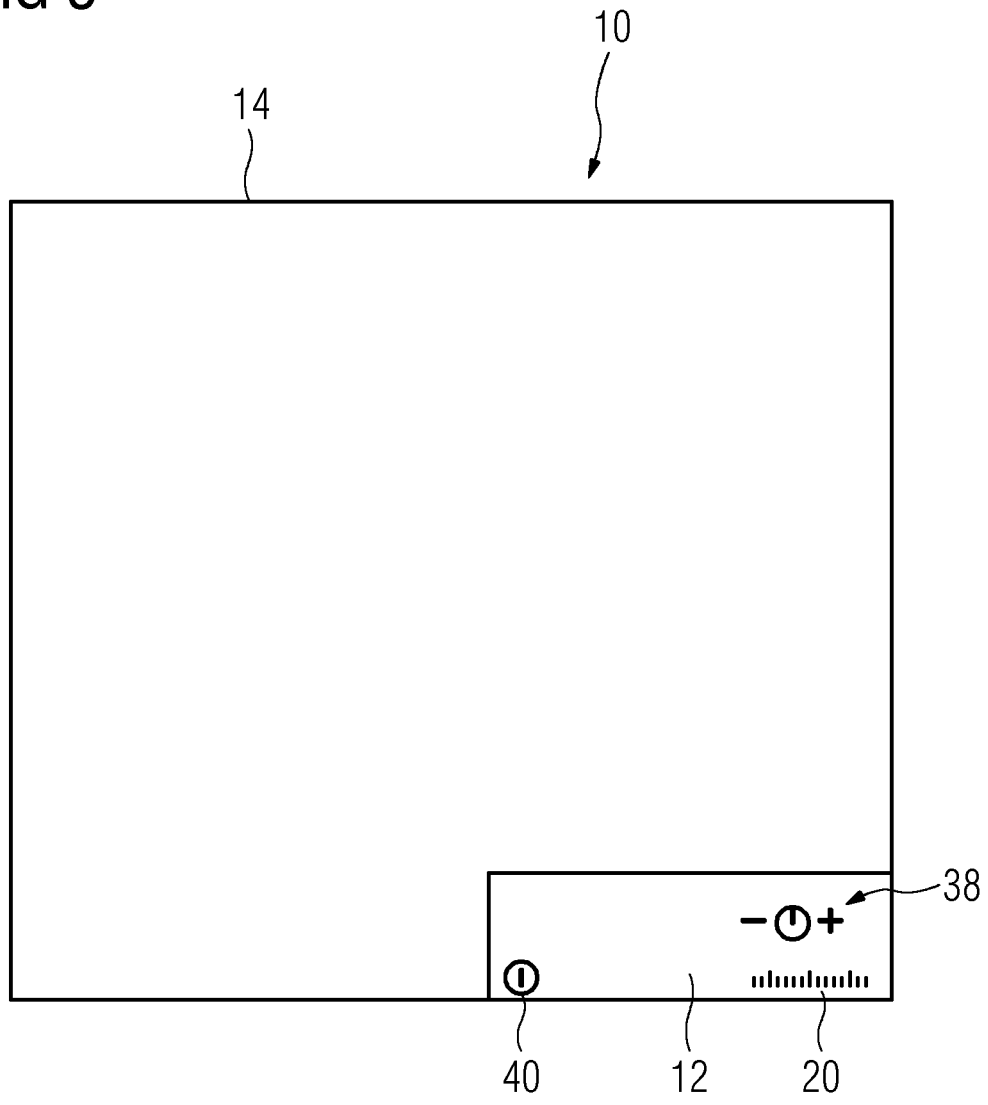

The present invention will be described in further detail with reference to the drawings, in which FIG. 1 illustrates a schematic top view of a user interface for a cooking hob according to a preferred embodiment of the present invention, FIG. 2 illustrates a schematic circuit diagram of the cooking hob according to the preferred embodiment of the present invention, and FIG. 3 illustrates a schematic top view of the cooking hob according to the preferred embodiment of the present invention.

FIG. 1 illustrates a schematic top view of a user interface 12 for a cooking hob 10 according to a preferred embodiment of the present invention. In this example, the cooking hob 10 is provided for six cooking zones.

The user interface 12 comprises a plurality of touch switch elements 18. A part of said touch switch elements 18 is backlit by a corresponding light source element 22. Preferably, said light source element 22 includes one or more light emitting diodes (LED). Further, the user interface 12 comprises one touch slide element 20. The user interface 12 is provided for an arrangement below a top panel 14 of the cooking hob 10, so that touch sensitive areas are formed on the top side of said top panel 14 and above said user interface 12.

The user interface 12 comprises a number of cooking zone display elements 24. In this example, the user interface 12 comprises six cooking zone display elements 24, and accordingly the cooking hob 10 includes six cooking zones. Each cooking zone display element 24 corresponds with one cooking zone. In this example, each cooking zone display element 24 includes three seven-segment displays. Moreover, the user interface 12 comprises a timer display element 36.

In this example, the timer display element 36 includes three seven-segment displays. Beside the timer display element 36 three timer touch switch elements 38 are arranged.

Three touch switch elements 18 are arranged beside one cooking zone display element 24 and correspond with one cooking zone of the cooking hob 10 in each case. The light source elements 22 correspond with the associated touch switch elements 18. Further, the light source element 22 corresponds with the associated cooking zone 16.

In this embodiment, only a part of the touch switch elements 18 is backlit by the light source element 22, while some of the touch switch elements 18 are provided without light source element 22.

The light source element 22 of the corresponding cooking zone is provided for indicating a detection of a pot arranged on said cooking zone. Preferably, the detection of the pot on the cooking zone is indicated by a first light signal during a first predetermined time interval. For example, the first light signal is a flashing of the associated light source element 22. Then, the touch slide element 20 is activated and provided for adjusting the power and/or temperature of said indicated cooking zone within the first predetermined time interval. For instance, the first predetermined time interval is five seconds. If the touch slide element 20 is not operated by the user within the first predetermined time interval, then the first light signal disappears. After this situation, the operation of the touch slide element 20 activates the first light signal again, so that the power and/or temperature can be set for the last known selected zone.

The light source element 22 is also provided for indicating an activated state of the corresponding cooking zone by a second light signal. In particular, the second light signal is a continuous lighting. The touch switch element 18 may select the corresponding cooking zone again. Then, the touch slide element 22 is activated during a second predetermined time interval. In this situation, the light source element 20 indicates the corresponding selected cooking zone and the activated state of the touch slide element 20 by the first light signal. The touch slide element 20 can be used for adjusting the power and/or temperature of the selected cooking zone within the second predetermined time interval.

The other light source elements 22 associated to the cooking zone may be provided for indicating the residual heat, for instance.

FIG. 2 illustrates a schematic circuit diagram of the cooking hob 10 according to the preferred embodiment of the present invention. The cooking hob 10 includes the user interface 12, a power board 26, three induction power generators 28 and six induction coils 30.

The user interface 12 is directly connected to the power board 26. The power board 26 is connected to the induction power generators 28 via a power line 32. Additionally, the power board 26 is connected to the induction power generators 28 via a synchronisation and communication line 34. Each induction power generators 28 is connected to two induction coils 30.

FIG. 3 illustrates a schematic top view of the cooking hob 10 according to the preferred embodiment of the present invention. The cooking hob 10 includes the top panel 14 and the user interface 12. The top panel 14 is arranged on the top side of the cooking hob 10. The user interface 12 is arranged in a front portion of the cooking hob 10 and below the top panel 14. In this example, the user interface 12 is arranged on the right hand side of the cooking hob 10.

The user interface 12 includes an on-off switch element 40. In this embodiment, the on-off switch element 40 is also a touch switch element. A symbol for the on-off switch element 40 is printed on the top panel 14. In a similar way, symbols for the touch slide element 20 and for three timer touch switch elements 38 are also printed on the top panel 14. The timer touch switch elements 38 include a down switch, a timer switch and an up switch. The down switch is characterized by a minus symbol. The timer switch is characterized by a clock symbol. The up switch is characterized by a plus symbol. All other touch switch elements 18 are not visible, if the light source elements 22 are deactivated.

The timer of the cooking hob 10 can be set for a certain cooking zone as follows. When the cooking zone is selected by touching the corresponding touch switch element 18, then the first light signal is activated. A time value can be adjusted by touching the up switch and/or the down switch. For instance, the time value is between 0 and 240 minutes. If no cooking zone is selected, then the time value can be adjusted for the last known activated cooking zone.

After the first predetermined time interval, the first light signal disappears, if the timer switch elements 38 are not operated by the user. During the first light signal is activated, also the set power and/or temperature of the associated cooking zone can be changed by operating the touch slide element 20.

By pressing at the timer switch characterized by the clock symbol, a minute minder is activated. Said minute minder can be adjusted by touching the up switch and down switch, respectively. The minute minder has priority for being shown by the timer display element 36 before the duration of the cooking zones. If the minute minder is activated and the user selects one of the cooking zones by the corresponding touch switch element 18, then the minute minder disappears and the duration of the selected cooking zone is shown by the timer display element 36. If no duration for the selected cooking zone is available, then nothing is shown by the timer display element 36.

The user interface 12 of the cooking hob 10 according to the present invention includes a relative low number of standard components, but not an expensive display or touch screens base on LCD or TFT technology. Further, most of said standard components have multiple functions. The standard components of the user interface 12 and their multiple functions allow a reduction of the costs for said user interface 12.

The cooking hob 10 may be an induction cooking hob or another cooking hob.

LIST OF REFERENCE NUMERALS

10 cooking hob
12 user interface
14 top panel
18 touch switch element
20 touch slide element
22 light source element
24 cooking zone display element
26 power board
28 induction power generator
30 induction coil
32 power line
34 synchronisation and communication line
36 timer display element
38 timer touch switch elements
40 on-off switch element

The invention claimed is:

1. A cooking hob comprising:
a transparent or semi-transparent top panel arranged on a top side of said cooking hob;
a user interface arranged below the top panel;
touch sensitive areas formed on the top side of said top panel and above said user interface; and
a plurality of cooking zones each having a corresponding pot detection device;
said user interface comprising:
a plurality of touch switch elements;
a touch slide element; and
at least one light source element,
wherein at least one of the touch switch elements corresponds with one of the plurality of cooking zones, and the at least one light source element corresponds with the at least one touch switch element and the corresponding cooking zone,
wherein when the pot detection device detects a pot in the corresponding cooking zone, the at least one light source element gives off a first light signal for a predetermined first time interval, and the touch slide element is activated during said predetermined first time interval for adjusting the power and/or temperature of the corresponding cooking zone, and
wherein the at least one light source element indicates an activated state of the corresponding cooking zone by a second light signal, and
wherein the at least one touch switch element is configured to activate the touch slide element for a second predetermined time interval, and the at least one light source element gives off the first light signal indicating the corresponding cooking zone and the activated state of the touch slide element during the second predetermined time interval, and
wherein the touch slide element is configured to adjust the power and/or temperature of the corresponding cooking zone within the second predetermined time interval, and
wherein if the touch slide element has not been operated by the user within the first predetermined time interval, and the first light signal disappears, the touch slide element can be touched to activate the first light signal again, and to set the power and/or temperature of a last known cooking zone, and
wherein the last known cooking zone is the later of the cooking zone at which the pot was last detected, or the cooking zone that the corresponding touch switch element last activated.

2. The cooking hob according to claim 1, wherein the first light signal is a flashing.

3. The cooking hob according to claim 1, wherein the second light signal is a continuous light.

4. The cooking hob according to claim 1, wherein the first predetermined time interval is between three and seven seconds, in particular five seconds.

5. The cooking hob according to claim 1, wherein the second predetermined time interval is between three and seven seconds, in particular five seconds.

6. The cooking hob according to claim 1, wherein at least one cooking zone display element corresponds with one cooking zone.

7. The cooking hob according to claim 6, wherein the cooking zone display element includes one or more seven-segment displays.

8. The cooking hob according to claim 1, wherein the user interface comprises a timer with at least one timer display element.

9. The cooking hob according to claim 8, wherein the timer display element includes one or more seven-segment displays.

10. The cooking hob according to claim 8, wherein the timer is settable for the corresponding cooking zone, if the corresponding cooking zone is selected by touching the corresponding touch switch element and the first light signal is activated.

11. The cooking hob according to claim 1, wherein the user interface comprises a minute reminder, wherein said minute reminder can be activated and adjusted by corresponding touch switch elements.

12. The cooking hob according to claim 11, wherein the minute reminder has a priority for being shown by the timer display element before a display of the duration of the cooking zone activation.

13. The cooking hob according to claim 1, wherein the at least one light source element includes at least one light emitting diode (LED).

14. The cooking hob according to claim 1, wherein the cooking hob is an induction cooking hob.

15. A method of operating a cooking hob having a user interface and a plurality of cooking zones each having a corresponding pot detection device, wherein the user interface has a plurality of touch switch elements, a touch slide element, and at least one light source element, said method comprising steps of:

detecting a pot by the pot detection device on a corresponding cooking zone;

giving off a first light signal at the at least one light source element for a predetermined first time interval;

activating the touch slide element during said predetermined first time interval for adjusting the power and/or temperature of the corresponding cooking zone; and giving off a second light signal at the at least one light source element to indicate an activated state of the corresponding cooking zone;

wherein if the touch slide element has not been operated by the user within the first predetermined time interval, and the first light signal disappears, then the method further comprises:

touching the at least one touch switch element to activate the touch slide element for a second predetermined time interval, giving off the first light signal at the at least one light source element to indicate the corresponding cooking zone and the activated state of the touch slide element during the second predetermined time interval, and touching the touch slide element to adjust the power and/or temperature of the corresponding cooking zone within the second predetermined time interval, wherein the touch slide element can be touched to activate the first light signal again, and to set the power and/or temperature of a last known cooking zone, and wherein the last known cooking zone is the later of the cooking zone at which the pot was last detected, or the cooking zone that the corresponding touch switch element last activated.

* * * * *